US011679314B2

(12) United States Patent
Carr et al.

(10) Patent No.: US 11,679,314 B2
(45) **Date of Patent: *Jun. 20, 2023**

(54) GOLF CLUB HEAD WITH IMPROVED VARIABLE THICKNESS STRIKING FACE

(71) Applicant: Acushnet Company, Fairhaven, MA (US)

(72) Inventors: Kyle A. Carr, Carlsbad, CA (US); David S. Cornelius, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 18 days.

This patent is subject to a terminal disclaimer.

(21) Appl. No.: 17/320,671

(22) Filed: May 14, 2021

(65) Prior Publication Data

US 2021/0299526 A1 Sep. 30, 2021

Related U.S. Application Data

(63) Continuation of application No. 16/828,406, filed on Mar. 24, 2020, now Pat. No. 11,033,785.

(51) Int. Cl.
*A63B 53/04* (2015.01)

(52) U.S. Cl.
CPC ..... *A63B 53/0466* (2013.01); *A63B 53/0412* (2020.08); *A63B 53/0416* (2020.08); *A63B 53/0437* (2020.08); *A63B 53/0458* (2020.08)

(58) Field of Classification Search
CPC ..... A63B 53/0466; A63B 53/0416; A63B 53/0458
USPC ..... 473/324, 329, 332
See application file for complete search history.

(56) References Cited

U.S. PATENT DOCUMENTS

| | | | | |
|---|---|---|---|---|
| 5,954,596 | A | 9/1999 | Noble et al. | |
| 6,398,666 | B1 | 6/2002 | Clayton | |
| 6,558,272 | B2 | 5/2003 | Helmstetter et al. | |
| 6,623,377 | B2 | 9/2003 | Evans | |
| 6,863,626 | B2 | 3/2005 | Evans | |
| 7,014,570 | B2 | 3/2006 | Evans | |
| 8,262,501 | B2 | 9/2012 | Curtis | |
| 8,956,246 | B2 | 2/2015 | Myrhum | |
| 8,979,672 | B2 * | 3/2015 | Samson | A63B 60/00 473/329 |
| 9,433,835 | B2 * | 9/2016 | Sugimae | A63B 53/04 |
| 9,561,409 | B2 | 2/2017 | Samson et al. | |
| 9,981,166 | B2 | 5/2018 | Samson et al. | |
| 11,033,785 | B1 * | 6/2021 | Carr | A63B 53/0408 |
| 2001/0051548 | A1 * | 12/2001 | Iwata | A63B 53/04 473/329 |
| 2003/0195058 | A1 * | 10/2003 | Rice | A63B 60/00 473/345 |

(Continued)

FOREIGN PATENT DOCUMENTS

| | | | |
|---|---|---|---|
| JP | 2011-125723 | A | 6/2011 |
| KR | 10-2018-0003419 | A | 1/2018 |

*Primary Examiner* — John E Simms, Jr.
(74) *Attorney, Agent, or Firm* — Ryan A. Reis

(57) ABSTRACT

A golf club head with improved striking face performance is disclosed herein. More specifically, a golf club head includes a striking face with a thickened central region surrounded by transition region that reduces radially in thickness as it extends away from the central region is disclosed. The striking face geometry results in more uniform characteristic time measurements across a large percentage thereof.

15 Claims, 13 Drawing Sheets

(56) References Cited

U.S. PATENT DOCUMENTS

| | | | | |
|---|---|---|---|---|
| 2006/0111198 | A1* | 5/2006 | Matsunaga | A63B 53/0466 473/349 |
| 2007/0066420 | A1* | 3/2007 | Imamoto | A63B 53/0466 473/332 |
| 2009/0275425 | A1 | 11/2009 | Hirano | |
| 2010/0255930 | A1* | 10/2010 | Rice | A63B 60/02 473/329 |
| 2011/0151992 | A1* | 6/2011 | Curtis | A63B 60/00 473/324 |
| 2012/0184394 | A1 | 7/2012 | Boyd | |
| 2012/0214611 | A1* | 8/2012 | Myrhum | A63B 60/02 473/324 |
| 2013/0190102 | A1 | 7/2013 | Greaney | |
| 2014/0038745 | A1 | 2/2014 | abe | |
| 2015/0119166 | A1* | 4/2015 | Deshmukh | A63B 53/04 473/349 |
| 2016/0067561 | A1* | 3/2016 | Golden | A63B 53/0466 473/342 |
| 2017/0007891 | A1* | 1/2017 | Jertson | A63B 53/047 |
| 2019/0192927 | A1* | 6/2019 | Bacon | A63B 60/00 |
| 2019/0282864 | A1* | 9/2019 | Aramaki | A63B 53/0462 |

* cited by examiner

Characteristic Time (μs) at Various Locations of First Conventional Striking Face

| Vertical distance from face center in mm | | | | | | | | | | | | | | | | | | | | | |
|---|---|---|---|---|---|---|---|---|---|---|---|---|---|---|---|---|---|---|---|---|---|
| 12 | -5 | -2 | -7 | -7 | -11 | -13 | -13 | -15 | -18 | -17 | -16 | -14 | -13 | -12 | -10 | -8 | -8 | -5 | -7 | -12 | -16 |
| 10 | 1 | 0 | -2 | -1 | -3 | -8 | -11 | -14 | -18 | -18 | -18 | -15 | -14 | -10 | -7 | -3 | -1 | -2 | 0 | -2 | -5 |
| 8 | 2 | -1 | -2 | -1 | -4 | -4 | -5 | -9 | -9 | -12 | -10 | -10 | -8 | -6 | -4 | -2 | -1 | -1 | 2 | 3 | 1 |
| 6 | 1 | 0 | -1 | 0 | 1 | 0 | 1 | -5 | -5 | -3 | -4 | -4 | -3 | -3 | -3 | -2 | 1 | 1 | 4 | 4 | 3 |
| 4 | 1 | -2 | -1 | -2 | 1 | 2 | -2 | -5 | -1 | -1 | -1 | -3 | -3 | -4 | -4 | -2 | 0 | 2 | 4 | 4 | 5 |
| 2 | 0 | -2 | -1 | -3 | -2 | 0 | -1 | -4 | -2 | -4 | -2 | -3 | -2 | -2 | -4 | -2 | -2 | 3 | 5 | 3 | 2 |
| 0 | -2 | -3 | -3 | -3 | -3 | -2 | 1 | -1 | -4 | -3 | -5 | -2 | -4 | -4 | -5 | -4 | -3 | 0 | 3 | 2 | 1 |
| -2 | -4 | -3 | -3 | -4 | -5 | -4 | -5 | -4 | -5 | -7 | -5 | -5 | -7 | -6 | -6 | -6 | -4 | -1 | 0 | 0 | -3 |
| -4 | -8 | -6 | -5 | -6 | -5 | -8 | -9 | -8 | -8 | -9 | -10 | -10 | -9 | -7 | -9 | -6 | -6 | -2 | -2 | -4 | -6 |
| -6 | -12 | -8 | -9 | -8 | -11 | -10 | -11 | -10 | -12 | -9 | -11 | -12 | -11 | -11 | -11 | -10 | -7 | -7 | -7 | -10 | -19 |
| -8 | -23 | -17 | -16 | -14 | -13 | -12 | -12 | -13 | -12 | -13 | -12 | -12 | -15 | -13 | -12 | -13 | -14 | -13 | -15 | -24 | -30 |
| | -20 | -18 | -16 | -14 | -12 | -10 | -8 | -6 | -4 | -2 | 0 | 2 | 4 | 6 | 8 | 10 | 12 | 14 | 16 | 18 | 20 |

Horizontal distance from face center in mm

FIG. 12
(Prior Art)

Characteristic Time (μs) at Various Locations of First Conventional Striking Face

| Vertical distance from face center in mm | | | | | | | | | | | | | | | | | | | | | |
|---|---|---|---|---|---|---|---|---|---|---|---|---|---|---|---|---|---|---|---|---|---|
| 12 | -7 | -7 | -7 | -9 | -11 | -14 | -15 | -17 | -19 | -18 | -17 | -16 | -15 | -14 | -13 | -13 | -12 | -11 | -13 | -16 | -19 |
| 10 | -6 | -4 | -4 | -6 | -9 | -10 | -14 | -18 | -20 | -20 | -19 | -17 | -16 | -11 | -12 | -8 | -6 | -7 | -8 | -8 | -11 |
| 8 | -6 | -5 | -3 | -3 | -6 | -6 | -9 | -13 | -13 | -16 | -20 | -13 | -10 | -9 | -7 | -6 | -3 | -5 | -3 | -5 | -6 |
| 6 | -5 | -4 | -4 | -2 | -1 | -4 | -3 | -8 | -7 | -8 | -9 | -8 | -6 | -5 | -6 | -4 | -3 | -5 | -3 | -3 | -4 |
| 4 | -7 | -6 | -4 | -4 | -2 | -1 | -3 | -6 | -6 | -7 | -5 | -5 | -5 | -7 | -6 | -5 | -4 | -3 | -3 | -2 | -4 |
| 2 | -8 | -10 | -5 | -5 | -4 | -3 | -2 | -7 | -3 | -6 | -4 | -4 | -5 | -6 | -8 | -7 | -6 | -4 | -2 | -4 | -5 |
| 0 | -9 | -9 | -7 | -6 | -5 | -5 | -2 | -5 | -5 | -7 | -6 | -4 | -5 | -7 | -8 | -8 | -7 | -7 | -4 | -6 | -7 |
| -2 | -11 | -10 | -8 | -8 | -6 | -5 | -6 | -6 | -5 | -7 | -6 | -6 | -7 | -8 | -9 | -10 | -7 | -7 | -6 | -9 | -12 |
| -4 | -13 | -12 | -11 | -10 | -10 | -9 | -11 | -9 | -8 | -8 | -9 | -8 | -8 | -9 | -11 | -9 | -9 | -10 | -10 | -12 | -16 |
| -6 | -20 | -15 | -14 | -12 | -12 | -12 | -12 | -11 | -10 | -10 | -9 | -12 | -11 | -10 | -12 | -12 | -12 | -13 | -14 | -18 | -24 |
| -8 | -27 | -22 | -18 | -16 | -16 | -14 | -14 | -12 | -12 | -14 | -12 | -11 | -12 | -13 | -13 | -17 | -18 | -18 | -23 | -27 | -36 |
| | -20 | -18 | -16 | -14 | -12 | -10 | -8 | -6 | -4 | -2 | 0 | 2 | 4 | 6 | 8 | 10 | 12 | 14 | 16 | 18 | 20 |

Horizontal distance from face center in mm

FIG. 13
(Prior Art)

Characteristic Time (ms) at Various Locations of Inventive Striking Face

| Vertical distance from face center in mm | | | | | | | | | | | | | | | | | | | | | |
|---|---|---|---|---|---|---|---|---|---|---|---|---|---|---|---|---|---|---|---|---|---|
| 12 | -10 | -8 | -7 | -8 | -7 | -11 | -12 | -12 | -13 | -14 | -12 | -12 | -11 | -11 | -9 | -7 | -7 | -9 | -11 | -13 | -19 |
| 10 | -8 | -5 | -5 | -5 | -7 | -7 | -11 | -15 | -14 | -15 | -13 | -12 | -9 | -7 | -7 | -5 | -4 | -3 | -6 | -7 | -11 |
| 8 | -9 | -7 | -5 | -3 | -4 | -3 | -6 | -8 | -8 | -9 | -11 | -10 | -7 | -5 | -4 | -3 | -2 | 2 | -3 | -5 | -9 |
| 6 | -8 | -8 | -5 | -4 | -3 | -1 | -4 | -4 | -7 | -4 | -4 | -3 | -4 | -5 | -4 | -3 | -2 | -3 | -4 | -3 | -8 |
| 4 | -10 | -7 | -6 | -5 | -2 | -2 | -3 | -3 | -6 | -3 | -3 | -2 | -3 | -6 | -6 | -7 | -5 | -4 | -5 | -6 | -8 |
| 2 | -12 | -7 | -5 | -4 | -4 | -1 | -1 | -2 | -4 | -3 | -2 | 0 | -3 | -6 | -6 | -7 | -5 | -4 | -4 | -7 | -8 |
| 0 | -9 | -9 | -5 | -5 | -2 | -2 | -2 | -3 | -3 | -5 | -1 | -1 | -3 | -5 | -7 | -7 | -7 | -7 | -7 | -9 | -11 |
| -2 | -8 | -7 | -8 | -4 | -6 | -3 | -3 | -3 | -3 | -4 | -2 | -3 | -4 | -8 | -8 | -6 | -7 | -6 | -11 | -10 | -15 |
| -4 | -10 | -8 | -6 | -7 | -6 | -6 | -6 | -4 | -6 | -4 | -4 | -5 | -6 | -7 | -7 | -7 | -8 | -10 | -9 | -14 | -16 |
| -6 | -14 | -10 | -9 | -7 | -8 | -6 | -5 | -6 | -7 | -5 | -7 | -6 | -6 | -7 | -8 | -8 | -9 | -13 | -14 | -23 | -24 |
| -8 | -23 | -16 | -14 | -12 | -9 | -9 | -9 | -7 | -7 | -9 | -8 | -9 | -10 | -10 | -9 | -11 | -14 | -15 | -22 | -25 | -33 |
| | -20 | -18 | -16 | -14 | -12 | -10 | -8 | -6 | -4 | -2 | 0 | 2 | 4 | 6 | 8 | 10 | 12 | 14 | 16 | 18 | 20 |

Horizontal distance from face center in mm

FIG. 14

GOLF CLUB HEAD WITH IMPROVED VARIABLE THICKNESS STRIKING FACE

RELATED APPLICATIONS

The present application is a continuation of U.S. application Ser. No. 16/828,406, filed on Mar. 24, 2020, the entirety of which is incorporated by reference herein.

FIELD OF THE INVENTION

The present invention relates generally to golf clubs, and more particularly to a golf club having a variable thickness striking face.

BACKGROUND OF THE INVENTION

Golf is hard. Hitting the golf ball far cannot only make the game of golf easier, but it can also make the game of golf more fun. There are many factors that increase how far a golfer can hit a golf ball. To name a few, a golfer can improve their swing, a golfer can improve their fitness, or a golfer can use a golf club that is designed to hit the ball further.

The governing bodies of golf, the USGA and the R&A, have established guidelines to control how much a golf club can contribute to distance gains. Specifically, among other limitations, the governing bodies have set limits on the coefficient of restitution (COR) of the face of the golf club.

While COR is a useful metric for analyzing golf club heads, it is difficult to implement the test with portable equipment. Therefore, the governing bodies have instituted a characteristic time (CT) test that can be measured with portable equipment. The CT test involves hitting the striking face of a golf club with a metal weight on a pendulum and measuring the amount of time the weight contacts the striking face.

As golf club technology has advanced and improved, design focus has transitioned from maximizing COR and CT of the striking face to improving the COR and CT of the striking face at locations other than the sweet spot of the striking face so that the distance of shots that are struck at the sweet spot of the striking face and at locations other than the center of the striking face will travel closer to the same distance. As controlling the distance that a golf ball will travel for a given swing is one of the most important aspects of the game, mitigating the effect of missing the center of the striking face is of critical importance.

Varying the thickness of the back portion of the striking face of the golf club head, and therefore the overall thickness of the striking face, improves the performance of the golf club head by adjusting the flexural stiffness of the striking face of the golf club head to strategically improve the size and shape of the sweet spot on the striking face; where the sweet spot is defined as the portion of the striking face capable of achieving a high COR relative to the rest of the striking face.

Many striking faces are designed to have variable thickness. There are many reasons to utilize variable face thickness (VFT). For example, making some portions of the striking face thinner and some thicker allows the COR and CT of a golf club to be increased while ensuring that the golf club is structurally sound to withstand repeated impacts with a golf ball.

While it is important to achieve a high COR at the center of the striking face, it is also important to ensure no locations on the striking face have a COR or CT that exceeds the limits set by the governing bodies. From a performance perspective, it is desirable for CT measurements to be at or near the limits set by the governing bodies.

FIGS. 12-13 show normalized CT maps of two different Prior Art striking face inserts. Each data point on a CT map represents a CT measurement taken at a different location on a striking face. The vertical axis on each CT map represents a vertical distance from the center of the striking face measured in 2 mm increments from 8 mm toward to the sole to 12 mm toward the crown. The centermost location on each CT map is indicated by a darkened border. It is noted that negative numbers on the vertical axis indicate soleward. The horizontal axis on each CT map represents a horizontal distance from the center of the striking face measured in 2 mm increments from 20 mm toward the toe to 20 mm toward the heel. It is noted that negative numbers on the horizontal axis indicate toeward.

Further, as it is inevitable that CT values will vary across the striking face, it is desirable to not only minimize variance in CT across the face, but also to ensure that the highest CT values on a given striking face are located at or near the center of the striking face. This is critical because it ensures that golf balls struck at or near the center of the striking face will exhibit the highest ball speeds, while also reducing the occurrence of "CT hotspots" away from the center of the striking face. A CT hotspot is defined as a region on a striking face that exhibits the highest CT. Such CT hotspots occurring away from the center of the striking face may result in CT values that exceed the limits set by the governing bodies without offering a performance benefit.

There are several ways to modify a striking face that exhibits CT hotspots away from the center of the striking face. First, the entirety of the striking face may be designed so that highest CT values on the striking face are within the limits set by the governing bodies. However, when the highest CT values on the striking face are located away from the center of the striking face, the center of the striking face will exhibit lower CT values and therefore lower ball speeds.

Second, the striking face may be designed such that CT hotspots are located at or near the center of the striking face to maximize ball speed at the center of the striking face while also ensuring that the entirety of the striking face exhibits CT values that are within the limits set by the governing bodies.

To best illustrate the differences between the different striking faces depicted in FIGS. 12-13, each CT map has been normalized against a predetermined threshold value that is within the CT limit set by the USGA and the R&A.

Further, the CT maps are depicted in grayscale where darker colors represent higher normalized CT values and lighter colors represent lower normalized CT. Representing a CT map in this way clearly shows the location of CT hotspots as darker regions and also shows the variance of CT across the entirety of a striking face.

Looking to FIG. 12, a CT map for a Prior Art striking face is shown. FIG. 12 shows that the center of the striking face exhibits CT values that are 5 μs below the predetermined threshold. Further, the highest CT values are actually located substantially heelward and toeward of the center of the striking face, with the highest normalized CT values of 5 μs over the predetermined threshold located 16 mm heelward and 2 mm crownward of the center of the striking face.

Looking deeper at the values presented in FIG. 12 shows that not only does the center of the face not exhibit the highest CT values, but also that there is a large variance across the striking face as the standard deviation across the striking face depicted in FIG. 12 is 5.8 μs while the average normalized CT value is 5.7 μs below the predetermined threshold.

In the case of the striking face represented by FIG. 12, 63 percent of the measured data points are within 10 μs of the predetermined threshold without exceeding the predetermined threshold, while 7 percent of the measured data points exceed the predetermined threshold.

It is also helpful to consider how the average normalized CT values change as a distance from the center of the striking face increases. For the striking face of FIG. 12, the average normalized CT value within +/−2 mm vertically and +/−2 mm horizontally of the center of the striking face is 2.8 μs below the predetermined threshold, the average normalized CT value within +/−4 mm vertically and +/−4 mm horizontally of the center of the striking face is 4.6 μs below the predetermined threshold, and the average normalized CT value within +/−8 mm vertically and +/−8 mm horizontally of the center of the striking face is 6.4 μs below the predetermined threshold.

Looking to FIG. 13, a CT map for a second Prior Art striking face is shown. FIG. 13 shows that while the center of the striking face exhibits CT values that are 6 μs below the predetermined threshold Further, the highest CT values are actually located substantially heelward and toeward of the center of the striking face, with the highest CT values of 1 μs below the predetermined threshold located 10 mm toeward and 4 mm crownward of the center of the striking face.

Looking deeper at the values presented in FIG. 13 shows that not only does the center of the face not exhibit the highest CT values, but also that there is a large variance across the striking face as the standard deviation across the striking face depicted in FIG. 13 is 5.3 μs while the average normalized CT value is 9.2 μs below the predetermined threshold.

Moreover, 54 percent of the measured data points are within 10 μs of the predetermined threshold without exceeding the predetermined threshold, while no measured data points exceed the predetermined threshold.

It is also helpful to consider how the average normalized CT values change as a distance from the center of the striking face increases. For the striking face of FIG. 13, the average normalized CT value within +/−2 mm vertically and +/−2 mm horizontally of the center of the striking face is 5.3 μs below the predetermined threshold, the average normalized CT value within +/−4 mm vertically and +/−4 mm horizontally of the center of the striking face is 6.0 μs below the predetermined threshold, and the normalized average CT value within +/−8 mm vertically and +/−8 mm horizontally of the center of the striking face is 6.9 μs below the predetermined threshold.

The striking faces represented by FIGS. 12-13 exhibit some normalized CT values that correlate with adequate ball speed. However, the highest normalized CT values are not located at the center of the striking face. As long as the highest normalized CT values are located away from the center of the striking face, it follows that either CT values at the center of the striking face will be less than the limit set by the governing bodies, or alternatively that portions of the striking face outside of the center may be non-conforming. Further, when normalized CT values exceed the predetermined threshold, it again follows that either center CT values will be less than the limit set by the governing bodies, or alternatively that portions of the striking face outside of the center may be deemed non-conforming.

Hence, as it can be seen from above, despite all the advancement in golf club technology, the current art has not carefully examined the geometry of the variable face thickness profile behind the striking face as it relates to ensuring not only a high COR, but also a more uniform CT across the striking face. Ultimately, it can be seen from above that there is a need in the art for a golf club head that has a variable thickness geometry that more uniformly distributes the CT of the striking face of the golf club including the various thickness levels throughout the striking face and maximizes CT values at or near the center of the striking face.

BRIEF SUMMARY OF THE INVENTION

According to an aspect of the present invention, a golf club head is provided that includes a crown, a sole, and a skirt. The golf club head may further include a striking face portion located at a frontal portion of said golf club head adapted to strike a golf ball, said striking face may include a central region having a substantially constant thickness; a transition region surrounding said central region and having a variable thickness between that of said central region and a perimeter region; and said perimeter region surrounding said transition region. The perimeter region may include a first perimeter sub-region having a substantially constant thickness that is less than said thickness of said central region; a second perimeter sub-region having a substantially constant thickness that is less than said thickness of said first perimeter sub-region; and transition perimeter sub-regions having a thickness that decreases between said thickness of said first perimeter sub-region and said thickness of said second perimeter sub-region.

According to another aspect of the present invention, a variable thickness striking face for a golf club is provided that includes a central region having a substantially constant thickness; a transition region surrounding said central region; and a perimeter region surrounding said transition region and including one or more substantially constant thickness sub-regions, where said transition region decreases in thickness radially from an outer perimeter of said central region to an outer perimeter of said transition region. The transition region may include a toe transition length being a horizontal distance from a toemost portion of said central region to said perimeter region; a heel transition length being a horizontal distance from a heelmost portion of said central region to said perimeter region; a crown transition length being a vertical distance from a crownmost portion of said central region to said perimeter region; and a sole transition length being a distance from a solemost portion of said central region to said perimeter region, where a Slope Area Ratio of said striking face is greater than about 6.0.

According to another aspect of the present invention, a golf club head is provided that includes a crown, a sole, and a skirt. The golf club head may further include a striking face portion located at a frontal portion of said golf club head adapted to strike a golf ball. The striking face portion may include a central region having a substantially constant thickness; a transition region surrounding said central region and having a thickness that decreases radially from an outer perimeter of said central region to an outer perimeter of a transition region; said perimeter region surrounding said transition region; a crown transition length being a vertical distance toward said crown between said central region and said perimeter region; and a sole transition length being a vertical distance toward said sole between said central region and said perimeter region; where a slope along said crown transition length is greater than a slope along said sole transition length.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

FIG. 12 shows a characteristic time map of a first Prior Art striking face;

FIG. 13 shows a characteristic time map of a second Prior Art striking face; and FIG. 14 shows a characteristic time map of a striking face in accordance with an exemplary embodiment of the present invention.

DETAILED DESCRIPTION

Figure 1:
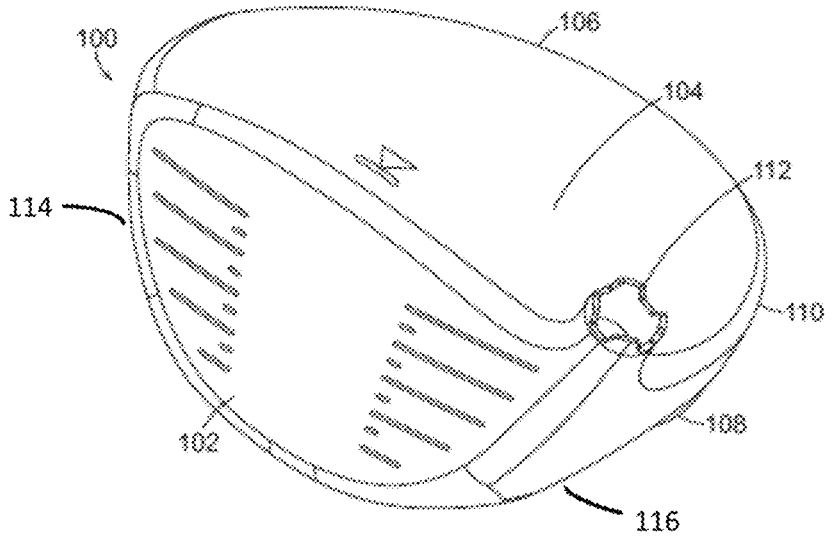
FIG. 1 shows a perspective view of a golf club head in accordance with an exemplary embodiment of the present invention.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

Embodiments described herein generally relate to golf clubs having an improved striking face. More specifically, some embodiments relate to golf club head constructions which normalize the characteristic time across a large portion of the striking face.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

FIG. 1 of the accompanying drawings shows a perspective view of a golf club head 100 in accordance with an exemplary embodiment of the present invention. The golf club head 100 shown in FIG. 1 may generally have a striking face portion 102 located at a frontal portion of the golf club head 100 that is adapted to strike a golf ball (not shown) and a body portion 104 that is connected to an aft portion of the striking face portion 102. The body portion 104 of the golf club head 100 may generally include a crown portion 106, a sole portion 108, a skirt portion 110, a hosel portion 112, a toe portion 114, and a heel portion 116. Although not externally visible, the striking face portion 102 of the golf club head 100 may generally have a unique internal geometry that varies the thickness of the striking face portion 102 in a manner described in greater detail below.

Figure 2:
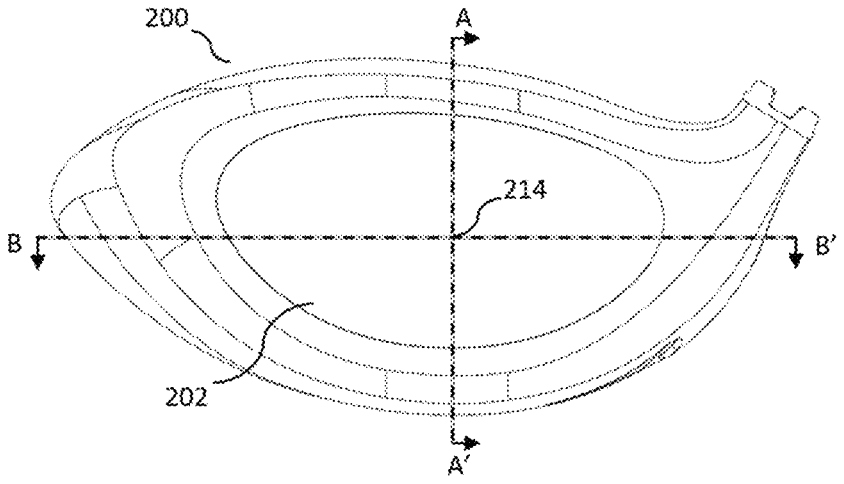
FIG. 2 shows a frontal view of a golf club head in accordance with an exemplary embodiment of the present invention.

FIG. 2 of the accompanying drawings showing a frontal view of a golf club head 200 provides an easy methodology to define the necessary cross-sectional views which allow for closer examination of the internal geometry of the striking face portion 102. More specifically, FIG. 2 shows a cross-sectional line A-A' spanning vertically in a crown to sole direction across a point 214 on the striking face 202 and cross-sectional line B-B' spanning horizontally in a heel to toe direction across the point 214. Point 214 is the projection on the outer surface of the striking face 202 of the center of the variable thickness geometry of the striking face 202. According to various embodiments of the present invention, the center of the variable thickness geometry of the striking face 202 may coincide with a geometric center of the striking face 202, a projection of the center of gravity of the golf club head 200 along the neutral axis on the striking face 202, or at any point on the striking face. It is worthwhile to mention here that the neutral axis may generally be described as an axis passing through the center of the striking face 202 and normal to a loft plane of the striking face 202.

Figure 3:
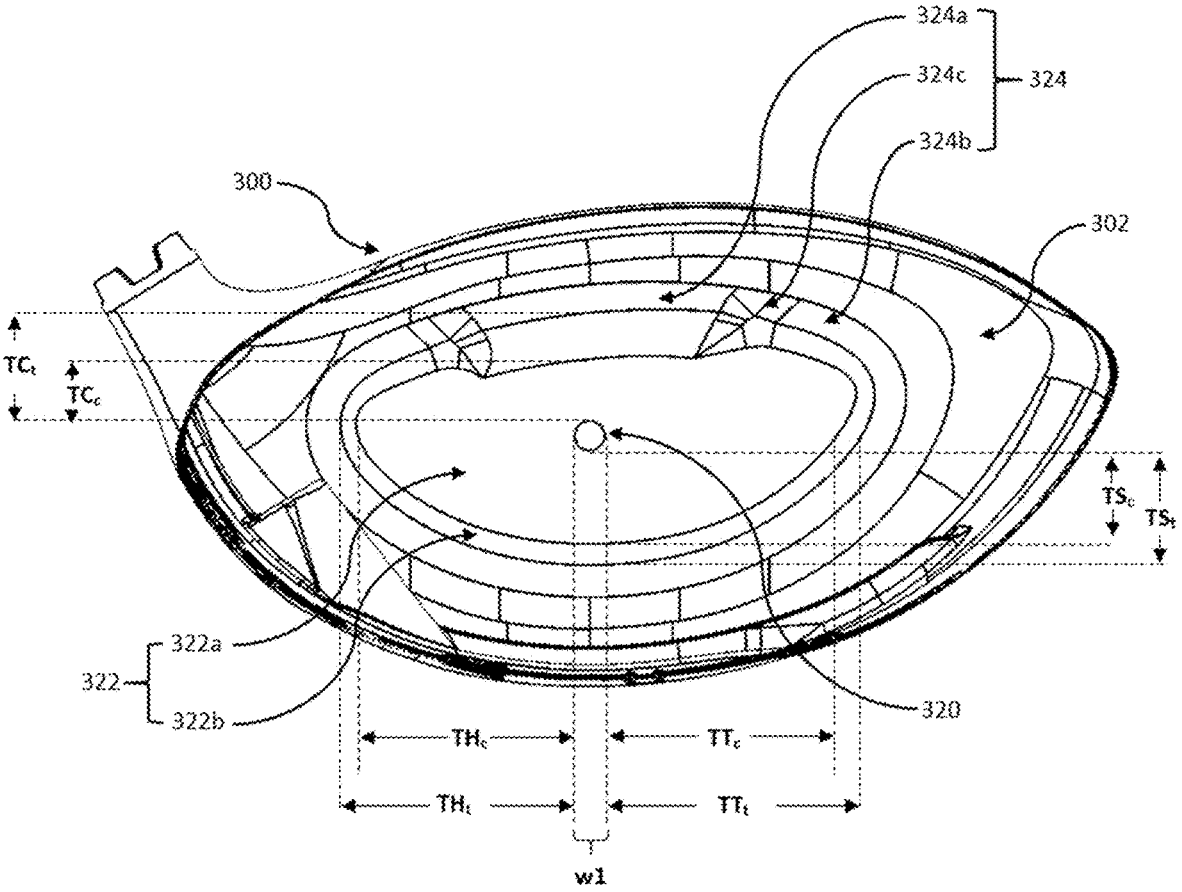
FIG. 3 shows a rear view of a cut-open golf club head that illustrates the striking face in accordance with an exemplary embodiment of the present invention.

FIG. 3 of the accompanying drawings shows a rear view of a golf club head 300 that has been cut open to illustrate the rear portion of the striking face 302. Striking face 302 may generally include a central region 320, a transition region 322, and a perimeter region 324.

At this time it is worthwhile to note that it is within the scope of this invention that the striking face 302 may either be formed simultaneously with, independently from, or partially independently from the other components of the golf club head 300.

In the present exemplary embodiment, the central region 320, the transition region 322, and the perimeter region 324 may be elements of a striking face insert that is welded or otherwise separately attached to the front portion of the golf club head 300.

The central region 320 may generally be substantially circular in shape and have a width w1 of less than about 6.0 mm, more preferably less than about 5.0 mm, and most preferably less than about 4.0 mm. Alternatively, the central region 320 may be substantially elliptical or may have a shape that more closely corresponds to the overall shape of the striking face insert.

The transition region 322 surrounds the central region 320. As the striking face 302 is not a perfect circle, the distance from the outer perimeter of the central region 320 to the outer perimeter of the transition region 322 varies based on the shape of the central region 320 and the transition region 322.

As shown in this current exemplary embodiment, the transition region 322 may include a constant slope sub-region 322*a* that surrounds the central region 320 and a blend sub-region 322*b* that surrounds the constant slope sub-region 322*a*. The constant slope sub-region 322*a* is referred to in this manner because the slope along a surface of the striking face 302 may be constant along any radius extending from an outer perimeter of the central region 320 to an outer perimeter of the constant slope sub-region 322*a*. This feature is unique in that the slope along any given radius is substantially constant, but slopes between different radii vary based upon the unique geometry of the striking face 302. Given this unique geometry, the overall shape of the constant slope sub-region 322*a* may be that of a frustum where the base perimeter of the frustum is the outer perimeter of the constant slope sub-region 322*a* and the upper perimeter of the frustum is the outer perimeter of the central region 320.

Alternatively, in embodiments where the transition region 322 does not include a blend sub-region 322*b*, the overall shape of the transition region 322 may be that of a frustum where the base perimeter of the frustum is the outer perimeter of transition region 322 and the upper perimeter of the frustum is the outer perimeter of the central region 320.

As shown in this current exemplary embodiment, a crown transition length $TC_c$ of the constant slope sub-region 322*a* is a vertical distance toward the crown between the outer perimeter of the central region 320 and the outer perimeter of the constant slope sub-region 322*a* and may be about 4.0 mm to about 10.5 mm, more preferably about 5.0 mm to about 9.5 mm, and most preferably about 6.5 mm to about 8.5 mm.

A total crown transition length $TC_t$ of the transition region 322 is a vertical distance toward the crown between the outer perimeter of the central region 320 and the outer perimeter of transition region 322 and may be about 10.0 mm to about 18.0 mm, more preferably about 11.0 mm to about 17.0 mm, and most preferably about 12.5 mm to about 15.0 mm.

A sole transition length $TS_c$ of the constant slope sub-region 322*a* is a vertical distance toward the sole between the outer perimeter of the central region 320 and the outer perimeter of the constant slope sub-region 322*a* and may be about 8.0 mm to about 17.0 mm, preferably about 10.0 mm to about 16.0 mm, and most preferably about 11.0 mm to about 15.0 mm.

A total sole transition length $TS_t$ of the transition region 322 is a vertical distance toward the sole between the outer perimeter of the central region 320 and the outer perimeter of the transition region 322 and may be about 12.0 mm to about 20.0 mm, preferably about 13.0 mm to about 19.0 mm, and most preferably about 14.0 mm to about 18.0 mm.

The toe transition length $TT_c$ of the constant slope sub-region 322*a* is a horizontal distance toward the toe between the outer perimeter of the central region 320 and the outer perimeter of the constant slope sub-region 322*a* and may be about 18.0 mm to about 37.0 mm, more preferably about 20.0 mm to about 35 mm, and most preferably about 22.0 mm to about 33.0 mm.

The total toe transition length $TT_t$ of the transition region 322 is a horizontal distance toward the toe between the outer perimeter of the central region 320 and the outer perimeter of the transition region 322 and may be about 24.0 mm to about 39.0 mm, more preferably about 26.0 mm to about 37.0 mm, and most preferably about 28.0 mm to about 35.0 mm.

The heel transition length $TH_c$ of the constant slope sub-region 322*a* is a horizontal distance toward the heel between the outer perimeter of the central region 320 and the outer perimeter of the constant slope sub-region 322*a* and may be about 18.0 mm to about 35.0 mm, preferable about 21.0 mm to about 33.0 mm, and most preferably about 23.0 mm to about 30 mm.

The total heel transition length $TH_t$ of the transition region 322 is a horizontal distance toward the heel between the outer perimeter of the central region 320 and the outer perimeter of the transition region 322 and may be about 25.0 mm to about 35.0 mm, preferably about 27.0 mm to about 33.0 mm, and most preferably about 28.5 mm to about 31.5 mm.

In accordance with an exemplary embodiment as shown in FIG. 3, the thickness of the constant slope transition sub-region 322*a* decreases radially from an outer perimeter of the central region 320 to an outer perimeter of the constant slope transition sub-region 322*a*. The thickness of the blend sub-region 322*b* further decreases radially from the outer perimeter of the constant slope sub-region 322*a* to the outer perimeter of the blend sub-region 322*b*. These features are described in more detail below with reference to FIGS. 4-7.

The perimeter region 324 surrounds the transition region 322 and may include one or more sub-regions of constant thickness. As shown in this current exemplary embodiment, the perimeter region 324 may include a first perimeter sub-region 324*a* and a second perimeter sub-region 324*b*.

When the perimeter region 324 includes more than one region of constant thickness, the perimeter region 324 may also include transition perimeter sub-regions 324*c* that transition in thickness between the constant thicknesses of the perimeter region 324.

Another aspect of the present invention may be illuminated when considering FIG. 3. As shown in FIG. 3, the central region 320 represents a small percentage of the total projected area of the striking face 302, while the transition region 322 represents a larger percentage of the total projected area of the striking face 302. In the discussion below, all projected areas are measured by projecting the striking face 302 on to a loft plane that is tangential to a geometric center of the striking face 302.

In this current exemplary embodiment, the projected area of the central region 322 may be between about 6 $mm^2$ to about 25 $mm^2$, more preferably between about 8 $mm^2$ to about 22 $mm^2$, and most preferably between about 10 $mm^2$ to about 20 $mm^2$.

The projected area of the constant slope sub-region 322*a* is between about 1000 $mm^2$ to about 1600 $mm^2$, most preferably between about 1100 $mm^2$ to about 1500 $mm^2$, and most preferably between about 1200 $mm^2$ to about 1400 $mm^2$. It is noted that this measurement excludes the projected area of the central region 320.

The projected area of the transition region 322 is between about 1500 $mm^2$ to about 2200 $mm^2$, most preferably between about 1600 $mm^2$ to about 2100 $mm^2$, and most preferably between about 1700 $mm^2$ to about 2000 $mm^2$. It is noted that this measurement excludes the projected area of the central region 320.

The projected area of the perimeter region 324 is between about between about 300 $mm^2$ to about 1500 $mm^2$, most preferably between about 500 $mm^2$ to about 1250 $mm^2$, and most preferably between about 600 $mm^2$ to about 950 $mm^2$. It is noted that this measurement excludes the projected area of the central region 320 and the transition region 322.

The combined projected area of the central region 320, the transition region 322, and the perimeter region 324 is between about 2000 $mm^2$ to about 3150 $mm^2$, preferably about 2200 $mm^2$ to about 2950 $mm^2$, and most preferably about 2400 $mm^2$ to about 2850 $mm^2$.

The total projected area of the striking face 302 is between about 2900 $mm^2$ to about 4200 $mm^2$, preferably about 3100 $mm^2$ to about 4100 $mm^2$, and most preferably about 3300 $mm^2$ to about 3950 $mm^2$.

In accordance with an exemplary embodiment of the present invention, it is desirable for the projected area of the central region 320 to account for between about 0.1 percent to about 1.0 percent of the total projected area of the striking face 302, preferably between about 0.2 percent to about 0.7 percent of the total projected area of the striking face 302, and most preferably between about 0.3 percent and about 0.6 percent of the total projected area of the striking face 302. A projected area of the central region 320 in this range is sufficiently large to form a CT hotspot at or near the center of the striking face 302, while being small enough that the transition region 322 accounts for a large percentage of the total projected area of the striking face 302.

More specifically, from the above, it can be concluded that the ratio of the projected area of the transition region 322 relative to the projected area of the striking face 302 is important. It is desirable for the projected area of the transition region 322 to account for between about 40.0 percent to about 65.0 percent of the total projected area of the striking face 302, preferably between about 45.0 percent to about 60.0 percent of the total projected area of the striking face 302, and most preferably between about 48.0 percent to about 57.0 percent of the total projected area of the striking face 302.

The ratio of the projected area of the constant slope sub-region 322*a* to the total projected area of the striking face 302 is also important. It is desirable for the projected area of the constant slope sub-region 322*a* to be between about 27.0 percent to about 48.0 percent of the total projected area of the striking face 302, preferably between about 30.0 percent to about 45.0 percent of the total projected area of the striking face 302, and most preferably between about 33.0 percent to about 42.0 percent of the total projected area of the striking face 302.

Another way to explore this relationship is to compare the projected area of the central region 320 to that of the transition region 322. It is desirable for the projected area of the central region 320 to be between 0.4 percent and 2.0 percent of the projected area of the transition region 322, preferably between 0.5 percent and 1.5 percent of the projected area of the transition region 322, and most preferably between about 0.6 percent and about 1.1 percent of the projected area of the transition region 322.

The ratio of the projected area of the central region 320 to that of the constant slope sub-region 322*a* is also important. It is desirable for the projected area of the central region 320 to be between 0.5 percent and 3.0 percent of the projected area of the constant slope sub-region 322*a*, preferably between 0.8 percent and 2.0 percent of the projected area of the constant slope sub-region 322*a*, and most preferably between about 1.0 percent and about 1.5 percent of the projected area of the constant slope sub-region 322*a*.

Projected areas of the transition region 322 and the constant slope sub-region 322*a* in these ranges provide a striking face 302 that exhibits CT measurements that are more uniform at locations extending away from the center of the striking face 302. As shown in FIG. 14 and discussed in greater detail below, a striking face in accordance with an exemplary embodiment of the presently claimed invention exhibits less variance in CT values measured across the face than other known striking faces.

Figure 4:
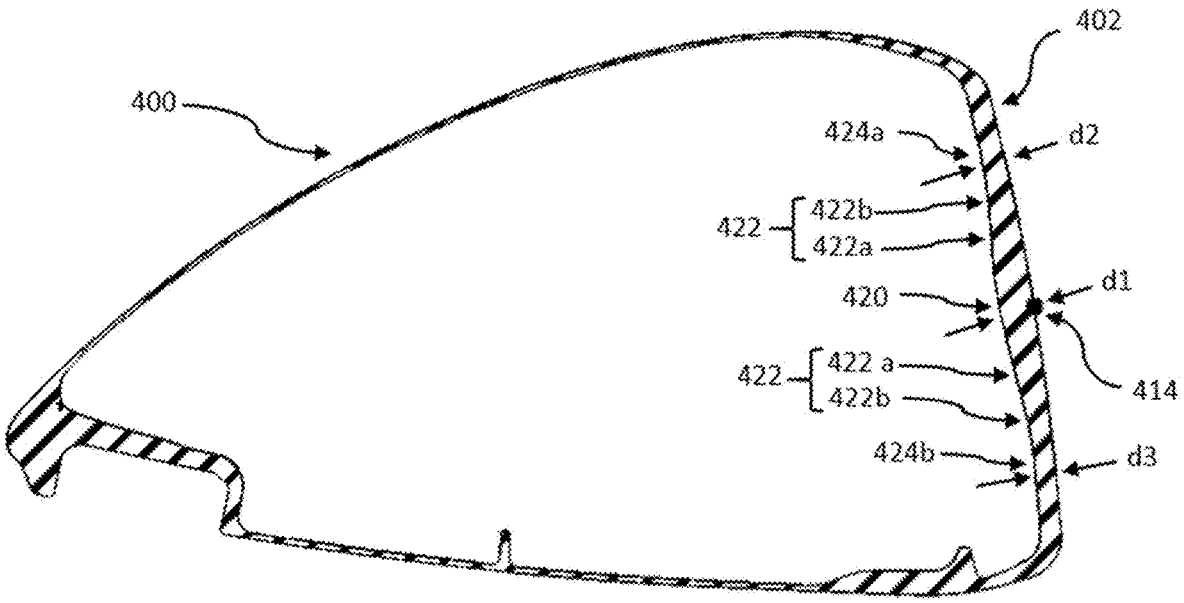
FIG. 4 shows a cross-sectional view of a golf club head in accordance with an exemplary embodiment of the present invention taken along cross-sectional line A-A' shown in FIG. 2.

FIG. 4 of the accompanying drawings shows a cross-sectional view of the golf club head 200 shown in FIG. 2 taken along cross-sectional line A-A'. This cross-sectional view of the golf club head 400 shown in FIG. 4 allows the variable thickness geometry behind the striking face 402 to be shown. More specifically, the striking face 402 may generally have a central region 420, a transition region 422, and a perimeter region including a first perimeter sub-region 424*a* and a second perimeter sub-region 424*b*.

The central region 420, as shown in this current exemplary embodiment, may generally have a constant thickness d1 of greater than about 3.00 mm, more preferably greater than about 3.30 mm, and most preferably greater than about 3.50 mm.

The first perimeter sub-region 424*a* forms a portion of the perimeter region proximate the crown and has a constant thickness d2 of less than about 3.1 mm, more preferably less than about 2.9 mm, and most preferably less than about 2.7 mm.

The second perimeter region 424*b* forms a portion of the perimeter region 424 proximate the heel, toe, and sole and has a thickness d3 of less than about 3.0 mm, more preferably less than about 2.8 mm, and most preferably less than about 2.6 mm.

The transition region 422 includes a constant slope sub-region 422*a* and a blend sub-region 422*b*. In accordance with an exemplary embodiment as shown in FIG. 4, a thickness of the striking face 402 reduces in a substantially linear manner within the constant slope sub-region 422*a* from the central region 420 to the blend sub-region 422*b*. The blend sub-region 422*b* transitions in thickness between the outer perimeter of the constant slope sub-region 422*a* to the first perimeter sub-region 424*a* and the second perimeter sub-region 424*b*. As described in greater detail below, as a result of this smooth transition, CT is more uniform across the entirety of the striking face 402 and hotspots are greatly reduced away from the center of the striking face 402.

Figure 5:
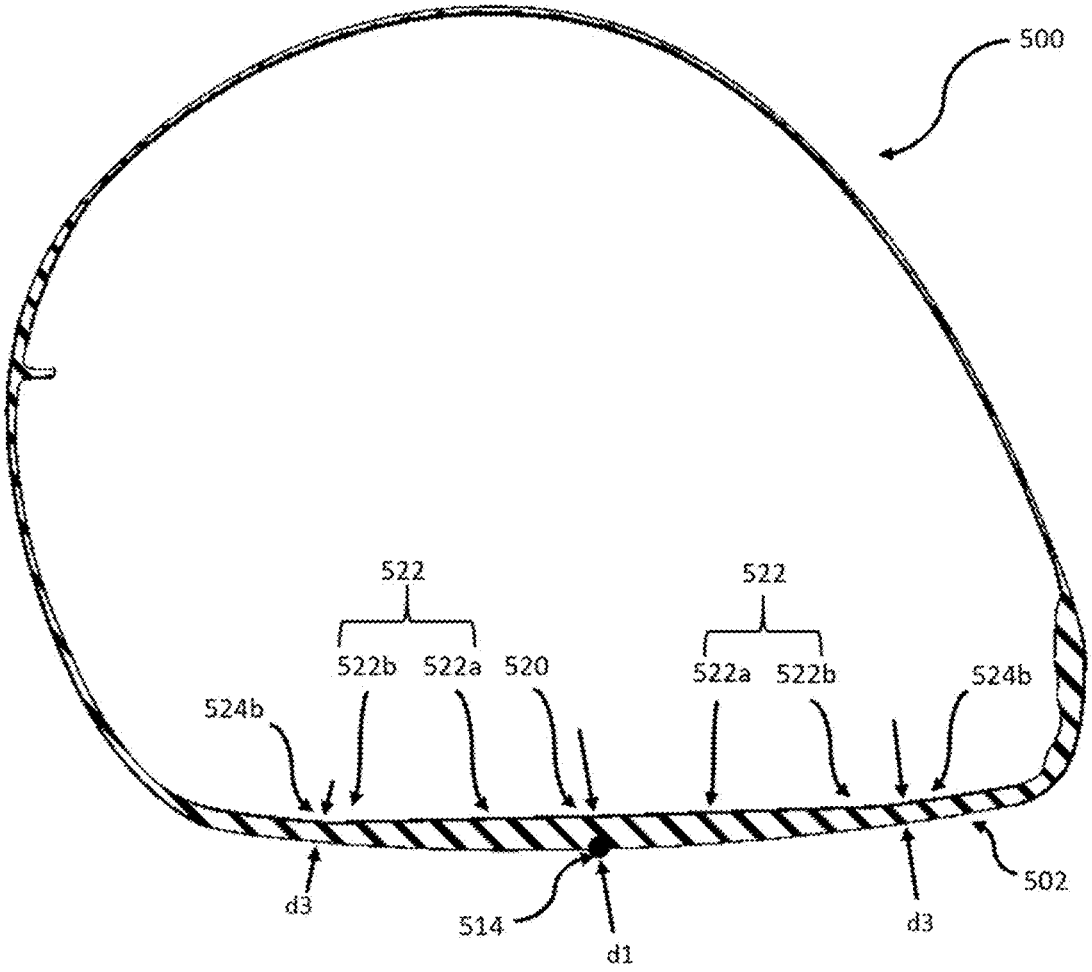
FIG. 5 shows a cross-sectional view of a golf club head in accordance with an exemplary embodiment of the present invention taken along cross-sectional line B-B' shown in FIG. 2.

FIG. 5 of the accompanying drawings shows a cross-sectional view of the golf club head 200 shown in FIG. 2 taken along cross-sectional line B-B'. This cross-sectional view of the golf club head 500 shown in FIG. 5 allows the variable thickness geometry behind the striking face 502 to be shown. As above, according to this exemplary embodiment, the central region 520 is centered about a point 514. The transition region 522 surrounds the central region 520, and the thickness of the striking face 502 may generally gradually decrease moving further away from the central region 520. The central region 520 has a constant thickness d1, and the perimeter region has one or more constant thicknesses that are less than the thickness d1. In the current view, the only portion of the perimeter region that is visible is the second perimeter sub-region 524*b* having a thickness of d3.

Figure 6:
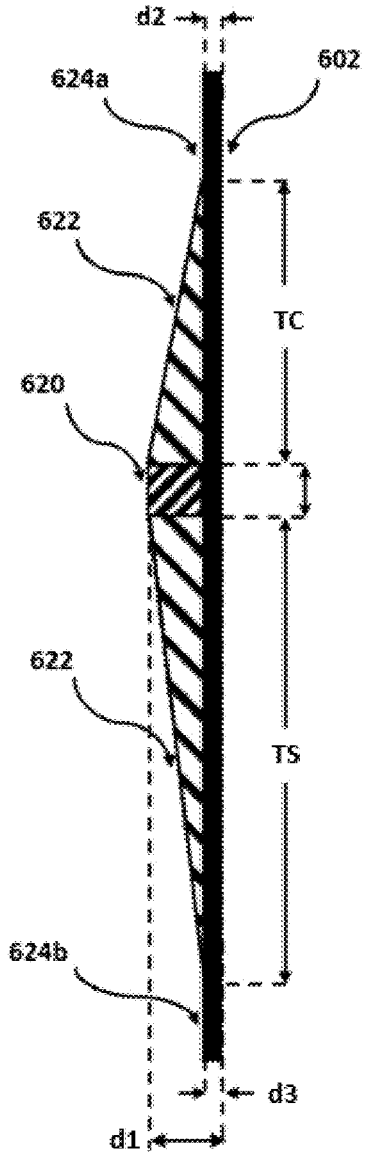
FIG. 6 shows an exaggerated view of a striking face in accordance with an exemplary embodiment of the present invention taken along cross-sectional line A-A' shown in FIG. 2.
Figure 7:
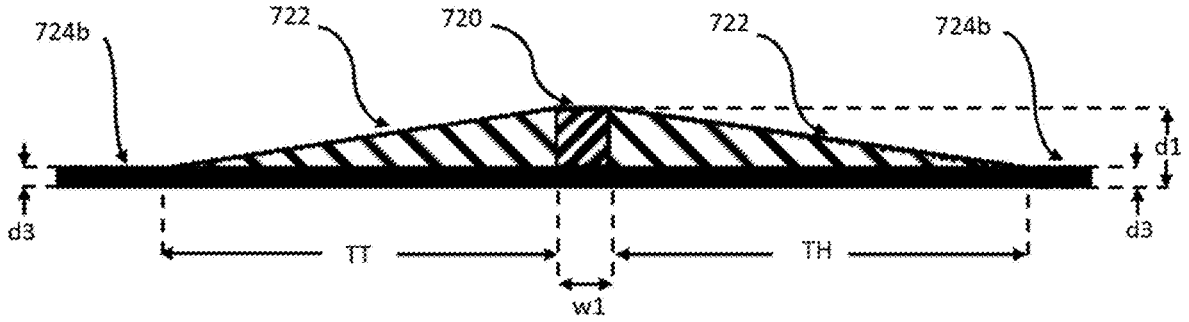
FIG. 7 shows an exaggerated view of a striking face in accordance with an exemplary embodiment of the present invention taken along cross-sectional line B-B' shown in FIG. 2.

To better illustrate the differences between thicknesses of the various regions of an inventive striking face in accordance with an embodiment of the present invention, FIG. 6 depicts an exaggerated cross-sectional view along the line A-A' and FIG. 7 depicts an exaggerated cross-sectional view along the line B-B'.

Referring to FIG. 6, the striking face 602 is shown without roll to better illustrate relative thickness, and therefore the striking surface of the striking face 602 appears flat. It is noted that this flattened geometry is also within the scope of the present invention and may be implemented in a golf club having a substantially flat face, such as an iron-type golf club.

Moreover, the scale of the thicknesses has been exaggerated to better show the geometry of the striking face 602. In general, the thickness of the transition region 622, as shown in this current exemplary embodiment, may generally linearly decrease from the central region 620 of the striking face 602 to the first perimeter sub-region 624*a*. According to the exemplary embodiment of the present invention shown in FIG. 6, the transition region 622 does not include a blend sub-region.

The central region 620 has a constant thickness d1, and the perimeter region has one or more constant thicknesses that are less than the thickness d1. As shown in this current exemplary embodiment, the perimeter region includes the first perimeter sub-region 624*a* having a constant thickness d2 and a second perimeter sub-region 624*b* having a constant thickness d3.

In the exemplary embodiment depicted in FIG. 6, the sole transition length TS is greater than the crown transition length TC and a slope $TS_{slope}$ along the sole transition length TS is less than a slope $TC_{slope}$ along the crown transition length TC. Slope is defined as the change in face thickness for a given transition length divided by the transition length. In accordance with embodiments of the present invention, the transition lengths may include just the constant slope sub-region, or may include the blend sub-region when a blend sub-region is incorporated into the striking face.

The slope $TS_{slope}$ along the sole transition length TS may be between about 0.05 and about 0.14, preferably between about 0.06 and about 0.13, and most preferably between about 0.07 and about 0.12. $TS_{slope}$ is equal to the thickness d1 of the central region 620 minus the thickness d3 of the second perimeter sub-region 624*b* divided by the sole transition length TS.

The slope $TC_{slope}$ along the crown transition length TC may be between about 0.08 and about 0.15, preferably between about 0.09 and about 0.14, and most preferably between about 0.07 and about 0.13. $TC_{slope}$ is equal to the thickness d1 of the central region 620 minus the thickness d2 of the first perimeter sub-region 624*a* divided by the crown transition length TC.

Referring to FIG. 7, the striking face 702 is shown without bulge to better illustrate relative thickness, and therefore the striking surface of the striking face 702 appears flat. It is noted that this flattened geometry is also within the scope of the present invention and may be applied to a golf club having a substantially flat face, such as an iron-type golf club.

Moreover, the scale of the thicknesses has been exaggerated to better show the shape of the striking face 702. In general, the transition region 722, as shown in this current exemplary embodiment, may generally linearly decrease from the central region 720 of the striking face 702 to the second perimeter sub-region 724*b*. According to the exemplary embodiment of the present invention shown in FIG. 7, the transition region 722 does not include a blend sub-region.

The central region 720 has a constant thickness d1, and the perimeter region has one or more constant thicknesses that are less than the thickness d1. As shown in this current exemplary embodiment, the perimeter region includes the second perimeter sub-region 724*b* having a constant thickness d3.

The slope $TT_{slope}$ along the toe transition length TT may be between about 0.03 and about 0.09, preferably between about 0.03 and about 0.07, and most preferably between about 0.04 and about 0.07. $TT_{slope}$ is equal to the thickness d1 of the central region 720 minus the thickness d3 of the second perimeter sub-region 724*b* divided by the toe transition length TT.

The slope $TH_{slope}$ along the heel transition length TH may be between about 0.03 and about 0.09, preferably between about 0.03 and about 0.08, and most preferably between about 0.04 and about 0.07. $TH_{slope}$ is equal to the thickness d1 of the central region 720 minus the thickness d3 of the second perimeter sub-region 724*b* divided by the heel transition length TH.

An evaluation of the different slopes mentioned above provides a very important relationship between the projected areas and slopes about the central region and transition region of the inventive striking face. When considering the striking face 602 as depicted in FIG. 6, a specific ratio of the average of the slopes $TC_{slope}$ of the crown transition length TC and $TS_{slope}$ of the sole transition length TS multiplied by the ratio of the projected area of the transition region 622 divided by the projected area of the central region 620 may generally be greater than about 6.0, more preferably greater than about 9.0, and most preferably greater than about 11.0; which is referred to as the Slope Area Ratio. The Slope Area Ratio is defined here by Equation (1) below:

$$T_{area}/C_{area} \times TC_{slope} + TS_{slope}/2 = \text{Slope Area Ratio} \quad \text{(Eq. 1)}$$

Where $T_{area}$ represents the projected area of the transition region; $C_{area}$ represents the projected area of the central region; $TC_{slope}$ represents the slope along the crown transition length TC; and $TS_{slope}$ represents the slope along the sole transition length TS.

Figure 8:
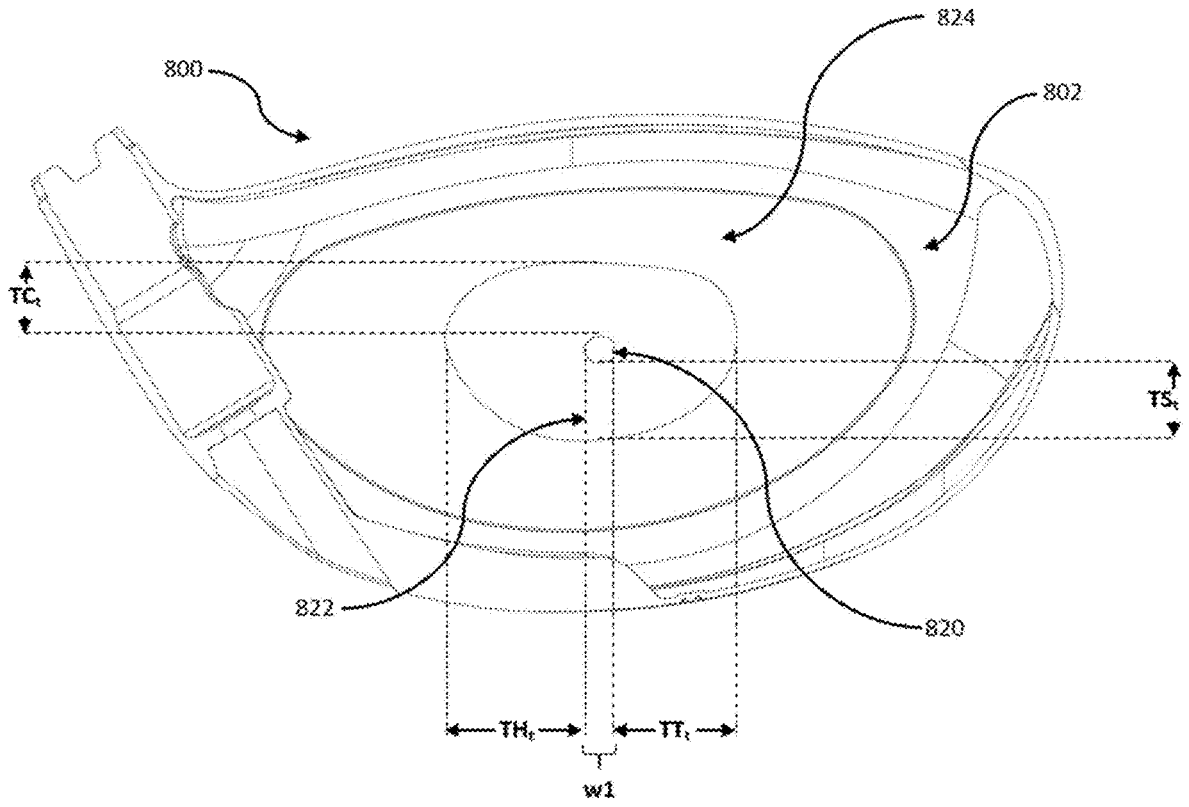
FIG. 8 shows a rear view of a cut-open golf club head that illustrates the striking face in accordance with an alternative embodiment of the present invention.

Referring to FIG. 8 of the accompanying drawings, a rear view of a golf club head 800 in accordance with an alternative embodiment of the present invention that has been cut open to illustrate the rear portion of the striking face 802 is provided. According to an exemplary alternative embodiment, striking face 802 may generally include central region 820, transition region 822, and perimeter region 824. As shown in FIG. 8, the perimeter region 824 includes only a single constant thickness portion and the transition region 824 does not include a blend sub-region. However, like golf club head 300 in FIG. 3 above, the transition region 822 still decreases in thickness radially from the central region 820 to the perimeter region 824.

While the striking face 802 shares similarities with the striking face 302, hereinbelow dimensions in which the striking face 802 differs from the striking face 302 are highlighted. Dimensions that fall within the ranges outlined above with regard to striking face 302 are omitted.

A total crown transition length $TC_t$ of the transition region 822 is a vertical distance toward the crown between the outer perimeter of the central region 820 and the outer perimeter of transition region 822 and may be about 6.0 mm to about 15.0 mm, more preferably about 7.0 mm to about 13.0 mm, and most preferably about 8.0 mm to about 11.0 mm.

A total sole transition length $TS_t$ of the transition region 822 is a vertical distance toward the sole between the outer perimeter of the central region 820 and the outer perimeter of the transition region 822 and may be about 6.0 mm to about 15.0 mm, preferably about 7.0 mm to about 13.0 mm, and most preferably about 8.0 mm to about 11.0 mm.

The total toe transition length $TT_t$ of the transition region 822 is a horizontal distance toward the toe between the outer perimeter of the central region 820 and the outer perimeter of the transition region 822 and may be about 11.0 mm to about 20.0 mm, more preferably about 12.0 mm to about 18.0 mm, and most preferably about 13.0 mm to about 16.0 mm.

The total heel transition length $TH_t$ of the transition region 822 is a horizontal distance toward the heel between the outer perimeter of the central region 820 and the outer perimeter of the transition region 822 and may be about 14.0 mm to about 23.0 mm, preferably about 15.0 mm to about 21.0 mm, and most preferably about 16.0 mm to about 19.0 mm.

The projected area of the transition region 822 is between about 300 $mm^2$ and about 1200 $mm^2$, preferably between about 400 $mm^2$ and about 1100 $mm^2$, and most preferably between about 500 $mm^2$ and about 1000 $mm^2$. It is noted that this measurement excludes the projected area of the central region 820.

The projected area of the perimeter region 824 is between about between about 1600 $mm^2$ to about 2700 $mm^2$, most preferably between about 1800 $mm^2$ to about 2500 $mm^2$, and most preferably between about 2000 $mm^2$ to about 2300 $mm^2$. It is noted that this measurement excludes the projected area of the central region 820 and the transition region 822.

In the exemplary embodiment shown in FIG. 8, the projected area of the transition region 822 accounts for between about 11.0 percent to about 24.0 percent of the total projected area of the striking face 802, preferably between about 13.0 percent to about 22.0 percent of the total projected area of the striking face 802, and most preferably between about 15.0 percent to about 20.0 percent of the total projected area of the striking face 802.

Another way to explore this relationship is to compare the projected area of the central region 820 to that of the transition region 822. It is desirable for the projected area of the central region 820 to be between 0.5 percent and 3.5 percent of the projected area of the transition region 822, preferably between 1.0 percent and 3.0 percent of the projected area of the transition region 822, and most preferably between about 1.5 percent and about 2.5 percent of the projected area of the transition region 822.

The perimeter region 824 has a substantially uniform thickness of between about 2.5 mm and about 3.1 mm, preferably between about 2.6 mm and about 3.0 mm, and most preferably between about 2.7 mm and 2.9 mm.

The slopes along the various transition lengths of striking face insert 802 are determined in the same manner as described above with regard to FIGS. 6-7. Therefore, reference may be made to FIGS. 6-7 when considering the slopes of striking face 802.

The slope $TS_{slope}$ along the sole transition length $TS_t$ may be between about 0.07 and about 0.14, preferably between about 0.08 and about 0.13, and most preferably between about 0.10 and about 0.11. $TS_{slope}$ is equal to the thickness of the central region 820 minus the thickness of the perimeter region 824 divided by the sole transition length $TS_t$.

The slope $TC_{slope}$ along the crown transition length $TC_t$ may be between about 0.07 and about 0.14, preferably between about 0.08 and about 0.13, and most preferably between about 0.10 and about 0.11. $TC_{slope}$ is equal to the thickness of the central region 820 minus the thickness of the perimeter region 824 divided by the crown transition length $TC_t$.

The slope $TT_{slope}$ along the toe transition length $TT_t$ may be between about 0.04 and about 0.10, preferably between about 0.05 and about 0.09, and most preferably between about 0.06 and about 0.08. $TT_{slope}$ is equal to the thickness of the central region 820 minus the thickness of the perimeter region 824 divided by the toe transition length $TT_t$.

The slope $TH_{slope}$ along the heel transition length $TH_t$ may be between about 0.03 and about 0.09, preferably between about 0.04 and about 0.08, and most preferably between about 0.05 and about 0.07. $TH_{slope}$ is equal to the thickness of the central region 820 minus the thickness of the perimeter region 824 divided by the heel transition length $TH_t$.

The Slope Area Ratio of striking face 802 is greater than about 3, preferably greater than about 4, and most preferably greater than about 5.

Figure 9:
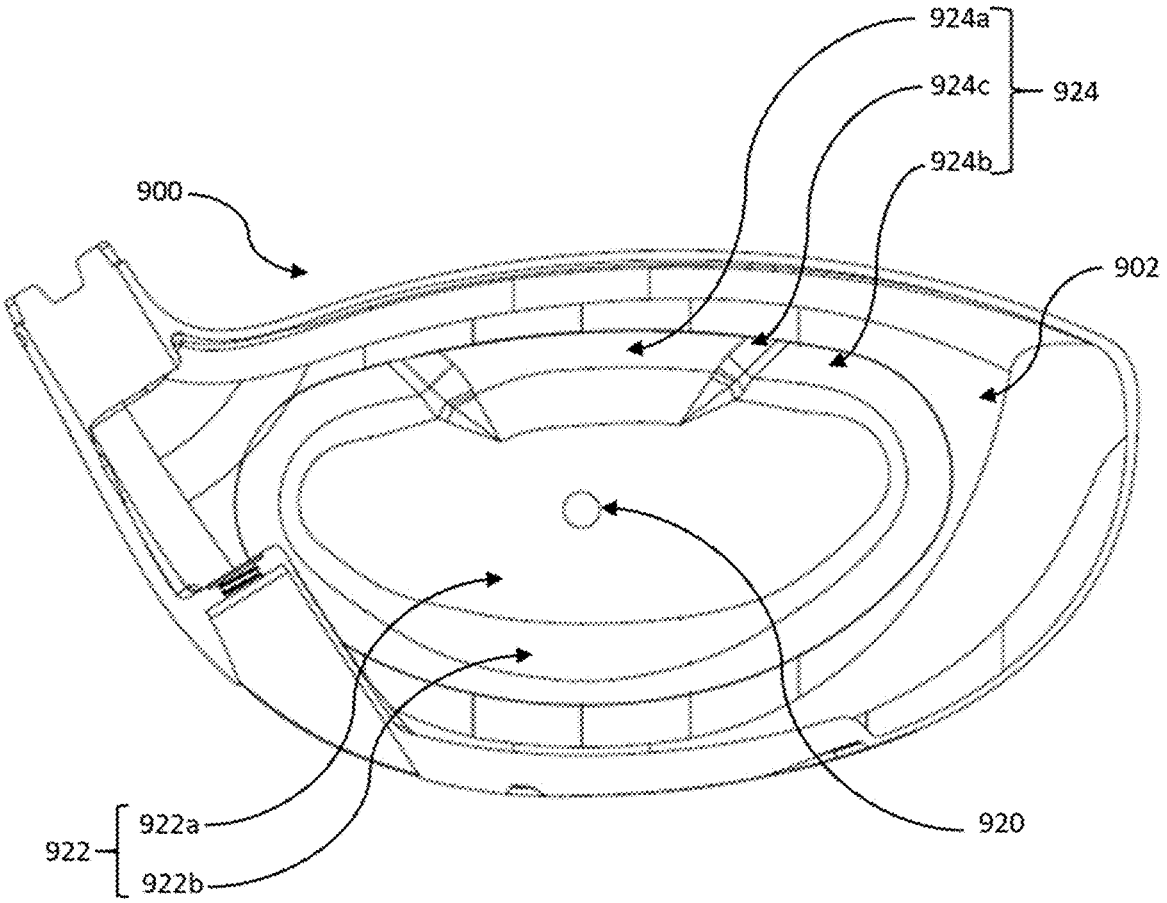
FIG. 9 shows a rear view of a cut-open golf club head that illustrates the striking face in accordance with another alternative embodiment of the present invention.

Referring now to FIG. 9 of the accompanying drawings, a rear view of a golf club head 900 in accordance with an alternative embodiment of the present invention that has been cut open to illustrate the rear portion of the striking face 902 is provided. According to an exemplary alternative embodiment, striking face 902 may generally include central region 920, transition region 922, and perimeter region 924. As shown in FIG. 9, the perimeter region 924 may include a first perimeter sub-region 924*a* having a substantially constant thickness and a second perimeter sub-region 924*b* having a different substantially constant thickness. Preferably the thickness of the first perimeter sub-region 924*a* is greater than a thickness of the second perimeter sub-region 924*b*. Much like golf club head 300 in FIG. 3 above, the transition region 1022 decreases in thickness radially from the central region 1020 to the perimeter region 1024.

The dimensions of striking face 902 fall within the ranges outlined above with regard to striking face 302.

Figure 10:
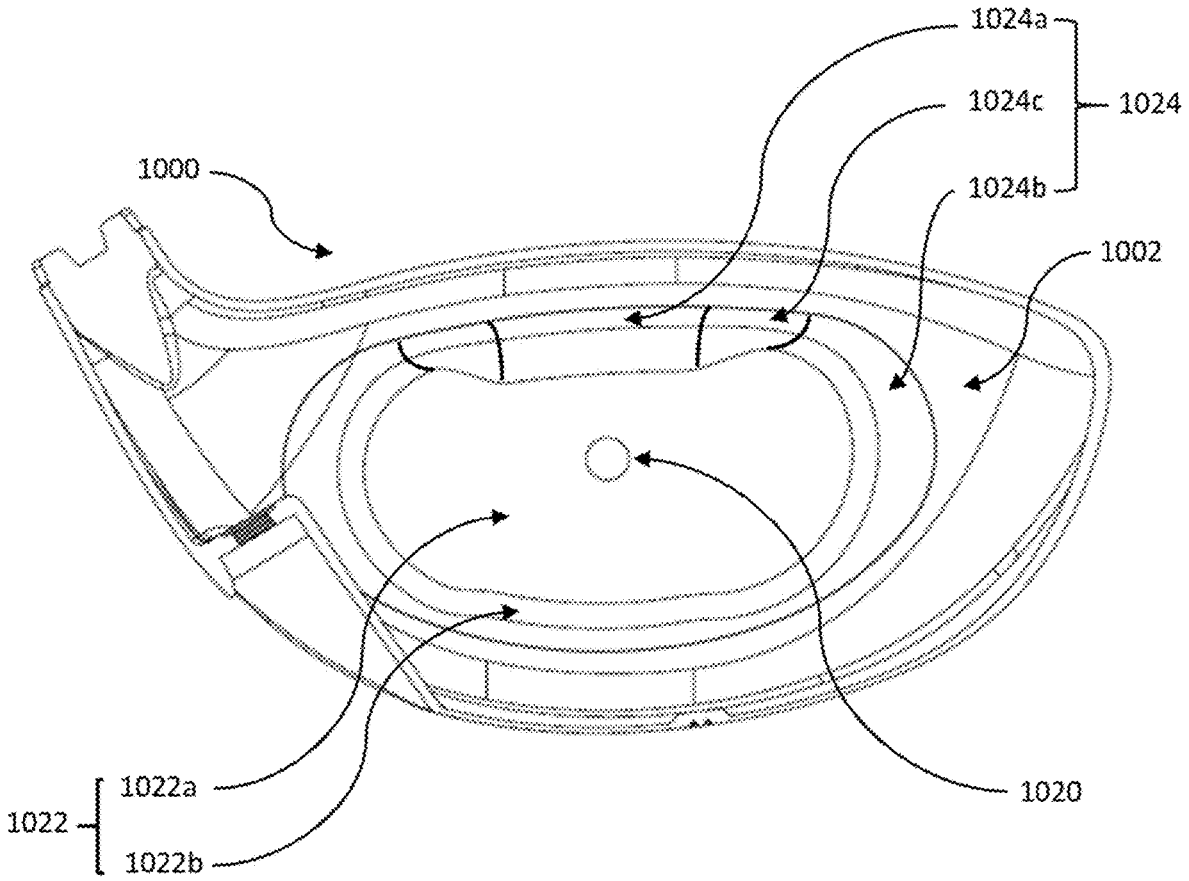
FIG. 10 shows a rear view of a cut-open golf club head that illustrates the striking face in accordance with yet another alternative embodiment of the present invention.

Referring now to FIG. 10 of the accompanying drawings, a rear view of a golf club head 1000 in accordance with an alternative embodiment of the present invention that has been cut open to illustrate the rear portion of the striking face 1002 is provided. According to an exemplary alternative embodiment, striking face 1002 may generally include central region 1020, transition region 1022, and perimeter region 1024. As shown in FIG. 10, the perimeter region 1024 may include a first perimeter sub-region 1024*a* having a substantially constant thickness and a second perimeter sub-region 1024*b* having a different substantially constant thickness. Preferably the thickness of the first perimeter sub-region 1024*a* is greater than a thickness of the second perimeter sub-region 1024*b*. Much like golf club head 300 in FIG. 3 above, the transition region 1022 decreases in thickness radially from the central region 1020 to the perimeter region 1024.

The dimensions of striking face 1002 fall within the ranges outlined above with regard to striking face 302.

Figure 11:
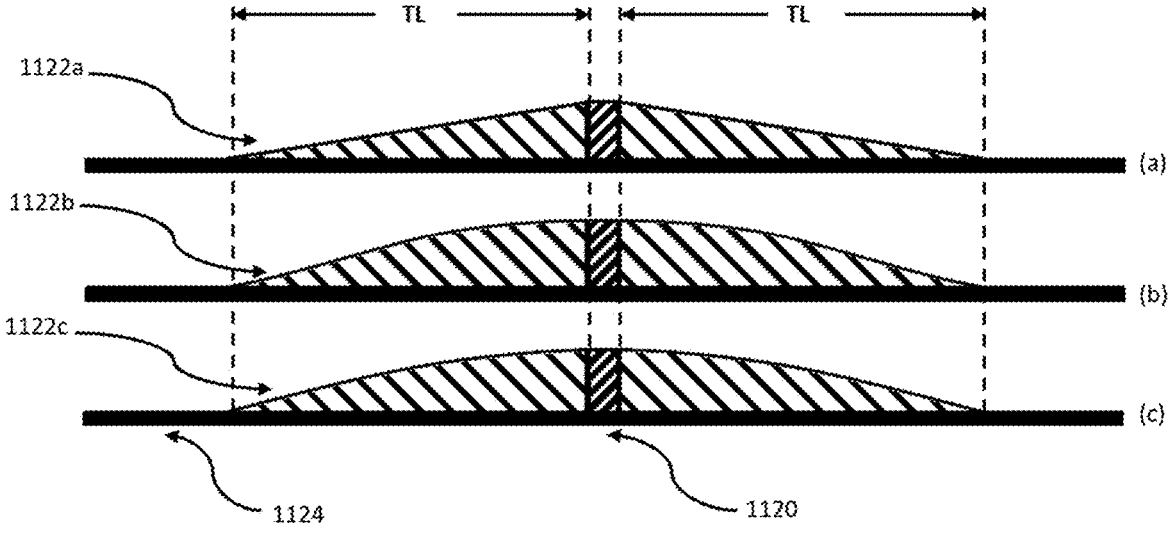
FIG. 11 shows exaggerated views of alternative configurations of the transition region of the striking face in accordance with yet another alternative embodiment of the present invention.

FIG. 11 shows exaggerated cross-sectional views along either A-A' or B-B' of three alternative constructions of a striking face. The views shown in FIG. 11 are symmetrical, therefore no distinction is made between crown, sole, heel, or toe.

As shown (a), the cross-sectional shape of a transition region 1122*a* may have a thickness that reduces in a linear manner from the central region 1120 toward the perimeter region 1124. As shown in (b), the cross-sectional shape of a transition region 1122*b* may have a thickness that reduces in a sinusoidal, logarithmic, or gaussian manner. As shown in (c), the cross-sectional shape of a transition region 1122*c* may have a thickness that reduces in an arc-like manner. In each of these various embodiments, the central region 1120 has a constant thickness and the transition regions 1122*a*, 1122*b*, 1122*c* reduce in thickness from the central region 1120 along a transition length TL to the perimeter region 1124.

FIG. 14 shows a normalized CT map of a striking face insert in accordance with an exemplary embodiment of the present invention, and illustrates numerous ways that the inventive striking face improves upon Prior Art striking faces, such as those represented by FIGS. 12-13. The CT map of FIG. 14 has been normalized against the same predetermined threshold value as in FIGS. 12-13. It is noted that the predetermined threshold is within the CT limit set by the governing bodies.

Looking to FIG. 14, the CT map for a striking face in accordance with an exemplary embodiment of the present invention exhibits normalized CT values that are at or below the predetermined threshold, with the highest normalized CT values being equal to the predetermined threshold and located just 2 mm heelward and 2 mm crownward of the center of the striking face.

Looking deeper at FIG. 14 shows that not only does the center of the face exhibit the highest CT values, but also that there is a smaller variance across the striking face as the standard deviation across the striking face depicted in FIG. 14 is 4.6 μs and the average normalized CT value is 7.3 μs below the predetermined threshold.

Moreover, 71 percent of the measured data points are within 10 μs of the predetermined threshold without exceeding the predetermined threshold, while none of the measured data points exceed the predetermined threshold. Normalized CT values within this range constitute CT values that correlate with substantial ball speed while still being conforming.

It is also helpful to consider how the average normalized CT values change as a distance from the center of the striking face increases. For the striking face of FIG. 14, the average normalized CT value within +/−2 mm vertically and +/−2 mm horizontally of the center of the striking face is 2.3 μs below the predetermined threshold, the average normalized CT value within +/−4 mm vertically and +/−4 mm horizontally of the center of the striking face is 3.3 μs below the predetermined threshold, and the normalized average CT value within +/−8 mm vertically and +/−8 mm horizontally of the center of the striking face is 4.4 μs below the predetermined threshold.

FIG. 14 shows every point on the striking face within +/−20 mm horizontally from the center of the striking face, within 8 mm toward the sole from the center of the striking face, and within 10 mm toward the crown from the center of the striking face has a CT value less than the predetermined threshold CT value. FIG. 14 shows every point on the striking face within +/−4 mm horizontally from the center of the striking face and within +/−4 mm vertically from the center of the striking face has a CT value within 6 us of the predetermined threshold CT value. FIG. 14 shows every point on the striking face within +/−6 mm horizontally from the center of the striking face and within +/−6 mm vertically from the center of the striking face has a CT value within 8 μs of the predetermined threshold CT value. FIG. 14 also shows every point on the striking face within +/−8 mm horizontally from the center of the striking face and within +/−8 mm vertically from the center of the striking face has a CT value within 11 μs of the predetermined threshold CT value.

This data tells us that a striking face in accordance with an exemplary embodiment represents a marked improvement upon the Prior Art striking face represented by FIGS. 12-13. A striking face in accordance with an exemplary embodiment of the present invention not only exhibits a centralized CT hotspot, but also a higher average normalized CT in areas surrounding the center of the striking face and a lower standard deviation across the striking face.

That means that the exemplary striking face exhibits high CT values not only at the center of the striking face, but across the entirety of the striking face. Moreover, as the exemplary striking face features a reduced standard deviation, the exemplary striking face yields a more uniform CT map that minimizes the likelihood of any portion of the striking face being deemed non-conforming.

Therefore, the exemplary striking face has obvious benefits in that it can be with designed with a face center having CT measurements closer to the limits set by the governing bodies with reduced possibility of exceeding said limits at any portion of said striking face. Moreover, a more uniform CT map such as illustrated by the inventive striking face ensures that ball speeds will be maximized over a larger percentage of the striking face.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head having a crown, a sole, and a skirt comprising:

a striking face located at a frontal portion of said golf club head adapted to strike a golf ball, said striking face comprising:

a central region at a center of said striking face having a substantially constant thickness;

a transition region surrounding said central region and having a variable thickness between that of said central region and a perimeter region; and said perimeter region surrounding said transition region and including two or more sub-regions of constant thickness, wherein every point on said striking face within +/−20 mm horizontally from said center of said striking face, within 8 mm toward said sole from said center of said striking face, and within 10 mm toward said crown from said center of said striking face has a characteristic time (CT) value less than a predetermined threshold CT value, wherein every point on said striking face within +/−4 mm horizontally from said center of said striking face and within +/−4 mm vertically from said center of said striking face has a CT value within 6 μs of said predetermined threshold CT value, and wherein a projected area of said central region is between about 6 $mm^2$ to about 25 $mm^2$ and a projected area of said transition region is between about 1500 $mm^2$ and about 2200 $mm^2$ wherein each said projected area is relative to a loft plane of said golf club head.

2. The golf club head of claim 1, wherein said perimeter region comprises:

a first perimeter sub-region immediately adjacent said transition region and having a substantially constant thickness that is less than said thickness of said central region;

a second perimeter sub-region immediately adjacent said transition region and having a substantially constant thickness that is less than said thickness of said first perimeter sub-region; and transition perimeter sub-regions having a thickness that decreases between said thickness of said first perimeter sub-region and said thickness of said second perimeter sub-region.

3. The golf club head of claim 1, wherein said transition region has a shape of a frustum, where a base perimeter of said frustum is an outer perimeter of said transition region and an upper perimeter of said frustum is an outer perimeter of said central region.

4. The golf club head of claim 1, wherein said decrease in thickness of said transition region is one of linear, logarithmic, gaussian, sinusoidal, and arc-like.

5. The golf club head of claim 2, wherein said thickness of said first perimeter sub-region is less than about 3.1 mm and said thickness of said second perimeter sub-region is less than about 3.0 mm.

6. A golf club head having a crown, a sole, and a skirt comprising:

a striking face located at a frontal portion of said golf club head adapted to strike a golf ball, said striking face comprising:

a central region at a center of said striking face having a substantially constant thickness;

a transition region surrounding said central region and having a variable thickness between that of said central region and a perimeter region; and said perimeter region surrounding said transition region and including two or more sub-regions of constant thickness, wherein every point on said striking face within +/−20 mm horizontally from said center of said striking face, within 8 mm toward said sole from said center of said striking face, and within 10 mm toward said crown from said center of said striking face has a characteristic time (CT) value less than a predetermined threshold CT value, wherein every point on said striking face within +/−6 mm horizontally from said center of said striking face and within +/−6 mm vertically from said center of said striking face has a CT value within 8 μs of said predetermined threshold CT value, and wherein a projected area of said central region is between about 6 $mm^2$ to about 25 $mm^2$ and a projected area of said transition region is between about 1500 $mm^2$ and about 2200 $mm^2$, wherein each said projected area is relative to a loft plane of said golf club head.

7. The golf club head of claim 6, wherein said perimeter region comprises:

a first perimeter sub-region immediately adjacent said transition region and having a substantially constant thickness that is less than said thickness of said central region;

a second perimeter sub-region immediately adjacent said transition region and having a substantially constant thickness that is less than said thickness of said first perimeter sub-region; and transition perimeter sub-regions having a thickness that decreases between said thickness of said first perimeter sub-region and said thickness of said second perimeter sub-region.

8. The golf club head of claim 6, wherein said transition region has a shape of a frustum, where a base perimeter of said frustum is an outer perimeter of said transition region and an upper perimeter of said frustum is an outer perimeter of said central region.

9. The golf club head of claim 6, wherein said decrease in thickness of said transition region is one of linear, logarithmic, gaussian, sinusoidal, and arc-like.

10. The golf club head of claim 7, wherein said thickness of said first perimeter sub-region is less than about 3.1 mm and said thickness of said second perimeter sub-region is less than about 3.0 mm.

11. A golf club head having a crown, a sole, and a skirt comprising:

a striking face located at a frontal portion of said golf club head adapted to strike a golf ball, said striking face comprising:

a central region at a center of said striking face having a substantially constant thickness;

a transition region surrounding said central region and having a variable thickness between that of said central region and a perimeter region; and said perimeter region surrounding said transition region and including two or more sub-regions of constant thickness, wherein every point on said striking face within +/−20 mm horizontally from said center of said striking face, within 8 mm toward said sole from said center of said striking face, and within 10 mm toward said crown from said center of said striking face has a characteristic time (CT) value less than a predetermined threshold CT value, wherein every point on said striking face within +/−8 mm horizontally from said center of said striking face and within +/−8 mm vertically from said center of said striking face has a CT value within 11 μs of said predetermined threshold CT value, and wherein a projected area of said central region is between about 6 $mm^2$ to about 25 $mm^2$ and a projected area of said transition region is between about 1500 $mm^2$ and about 2200 $mm^2$ wherein each said projected area is relative to a loft plane of said golf club head.

12. The golf club head of claim 11, wherein said perimeter region comprises:

a first perimeter sub-region immediately adjacent said transition region and having a substantially constant thickness that is less than said thickness of said central region;

a second perimeter sub-region immediately adjacent said transition region and having a substantially constant thickness that is less than said thickness of said first perimeter sub-region; and transition perimeter sub-regions having a thickness that decreases between said thickness of said first perimeter sub-region and said thickness of said second perimeter sub-region.

13. The golf club head of claim 11, wherein said transition region has a shape of a frustum, where a base perimeter of said frustum is an outer perimeter of said transition region and an upper perimeter of said frustum is an outer perimeter of said central region.

14. The golf club head of claim 11, wherein said decrease in thickness of said transition region is one of linear, logarithmic, gaussian, sinusoidal, and arc-like.

15. The golf club head of claim 12, wherein said thickness of said first perimeter sub-region is less than about 3.1 mm and said thickness of said second perimeter sub-region is less than about 3.0 mm.

* * * * *